United States Patent [19]

Gottschlich et al.

[11] Patent Number: 4,487,573

[45] Date of Patent: Dec. 11, 1984

[54] BURNER

[75] Inventors: Chad F. Gottschlich, Philadelphia; Leland H. S. Roblee, Jr., Ambler, both of Pa.; Howard H. Seemann, Seaford, N.Y.; William G. Bates, Sellersville; Richard F. Spahr, Ambler, both of Pa.

[73] Assignee: Selas Corporation of America, Dresher, Pa.

[21] Appl. No.: 406,876

[22] Filed: Aug. 10, 1982

Related U.S. Application Data

[63] Continuation of Ser. No. 122,844, Feb. 20, 1980, abandoned.

[51] Int. Cl.[3] ..... F23D 13/12

[52] U.S. Cl. ..... 431/348; 431/185

[58] Field of Search ..... 431/116, 171, 175, 185, 431/284, 285, 347, 348, 353

[56] References Cited

U.S. PATENT DOCUMENTS

| | | | |
|---|---|---|---|
| 2,539,165 | 1/1951 | Saha | 431/116 |
| 2,935,127 | 5/1960 | Stalego | 431/348 |
| 3,692,460 | 9/1972 | Morck, Jr. | 431/348 |

FOREIGN PATENT DOCUMENTS

| | | | |
|---|---|---|---|
| 784765 | 10/1957 | United Kingdom | 431/116 |

*Primary Examiner*—Carroll B. Dority, Jr.
*Attorney, Agent, or Firm*—Austin R. Miller

[57] ABSTRACT

A vortex burner is provided in a burner block, having a sleeve spaced within the burner block, the sleeve being shorter than the burner block opening and spaced within such opening to provide a passageway between them. The burner block has an exvoluting cup which creates negative pressure therein, tending to draw cooling air inwardly into the cup, cooling the short sleeve.

1 Claim, 2 Drawing Figures

BURNER

This is a continuation of application Ser. No. 06/122,844, filed Feb. 20, 1980, now abandoned.

SUMMARY OF THE INVENTION

This invention relates to a burner, particularly to an industrial burner constructed and arranged for burning gas. This invention particularly relates to a vortex burner having improved flame stability and which is capable of producing an emitted flame that clings to the surface of the burner cup. This invention further relates to a vortex burner having a more uniform heat flux pattern than those of the prior art, and having improved annulus pressure characteristics resulting in less critical alignment requirements between the burner parts. The burner of this invention has numerous other important advantages, as will be explained in further detail hereinafter.

PRIOR ART

The Patent to Morck U.S. Pat. No. 3,692,460, assigned to Selas Corporation of America of Dresher, Pa. which corporation is also the assignee hereof, relates to an industrial burner capable of using various types of fuel gas through a wide range of heat release. The burner of the Morck Patent comprises a cylindrical tube inserted in a furnace wall with one end terminating substantially at the base of a cup-shaped depression formed in the face of the furnace wall. Fuel gas is discharged in a tangential direction in the tube at a location near the base of the cup-shaped depression. Combustion supporting air is drawn through the tube to mix with the gas and to burn along the face of the cup-shaped depression. In the burner of the Morck Patent, a burner sleeve is provided which extends substantially from end to end with respect to the opening provided in the furnace wall and in the burner block, and the spacing between the opening and the sleeve provides an annulus which extends substantially the entire length of the sleeve and of the opening.

Although the burner of the Morck Patent has met with very substantial commercial success, and has been widely accepted for its numerous advantageous properties, there is a possibility that, with certain types of furnace blocks and burner blocks, particularly where cracks or openings develop in the furnace and casing and have not been carefully blocked off by the persons constructing the furnace and casing, hot combustion products have a potential for migration through the cracks to the furnace wall, eventually resulting in a tendency to overheat.

It is accordingly an object of this invention to provide a vortex burner which may be utilized in conjunction with a furnace wall and/or a burner block, which overcomes the disadvantages referred to above. It is a particular object of this invention to provide a burner which minimizes the tendency toward furnace overheating in the event of cracking of the furnace wall or the burner block, or separation of the casing, or both.

Still another object of this invention is to provide a novel burner which is less expensive to manufacture and easier to install and to operate, and which has less tendency to require adjustment than burners of the prior art.

A particular advantage of this invention is to provide a burner which can be made of relatively inexpensive materials, but which has long life even during service under intense conditions.

Other objects and advantages of this invention, including the simplicity and economy of the same and the ease with which it may be applied to a wide variety of existing furnaces, will further appear hereinafter, and in the drawings.

DRAWINGS

FIG. 1 is a longitudinal sectional view of a portion of a furnace wall and burner block, into which a burner of the prior art has been inserted, with certain portions shown exaggerated in size, for ease of understanding, and FIG. 2 is a similar longitudinal sectional view showing a burner embodying features of this invention, installed in a furnace wall and positioned in conjunction with a burner cup.

DETAILED DESCRIPTION

Figure 2:
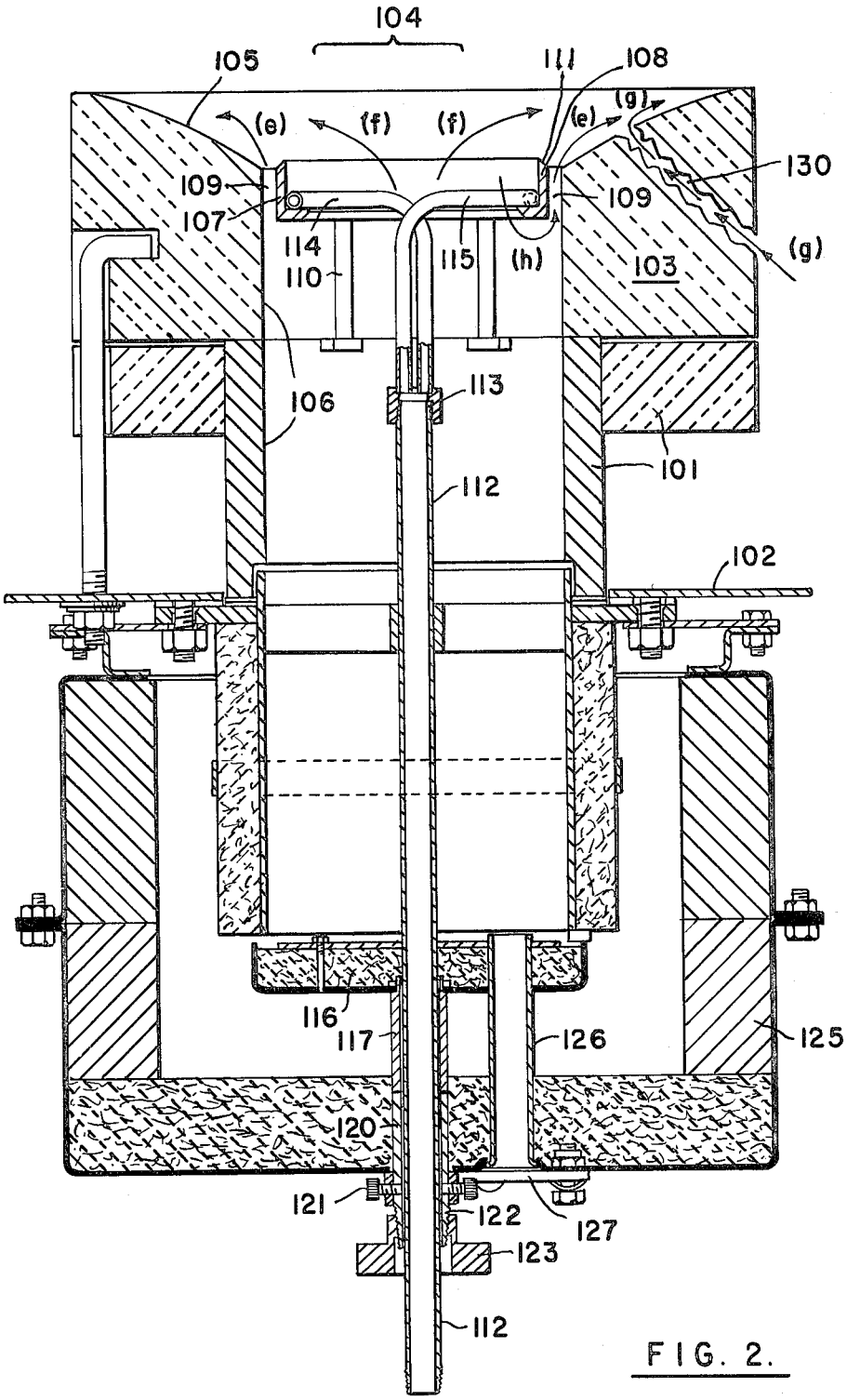

In the specification which follows, specific terms will be utilized in the interest of clarity, having particular reference to the specific embodiment of the invention selected for illustration in the drawing. The use of such specific terms, and the selection of the specific embodiment shown in FIG. 2, are not intended to imply any limitation with respect to the scope of the invention, which is defined in the appended claims.

Figure 1:
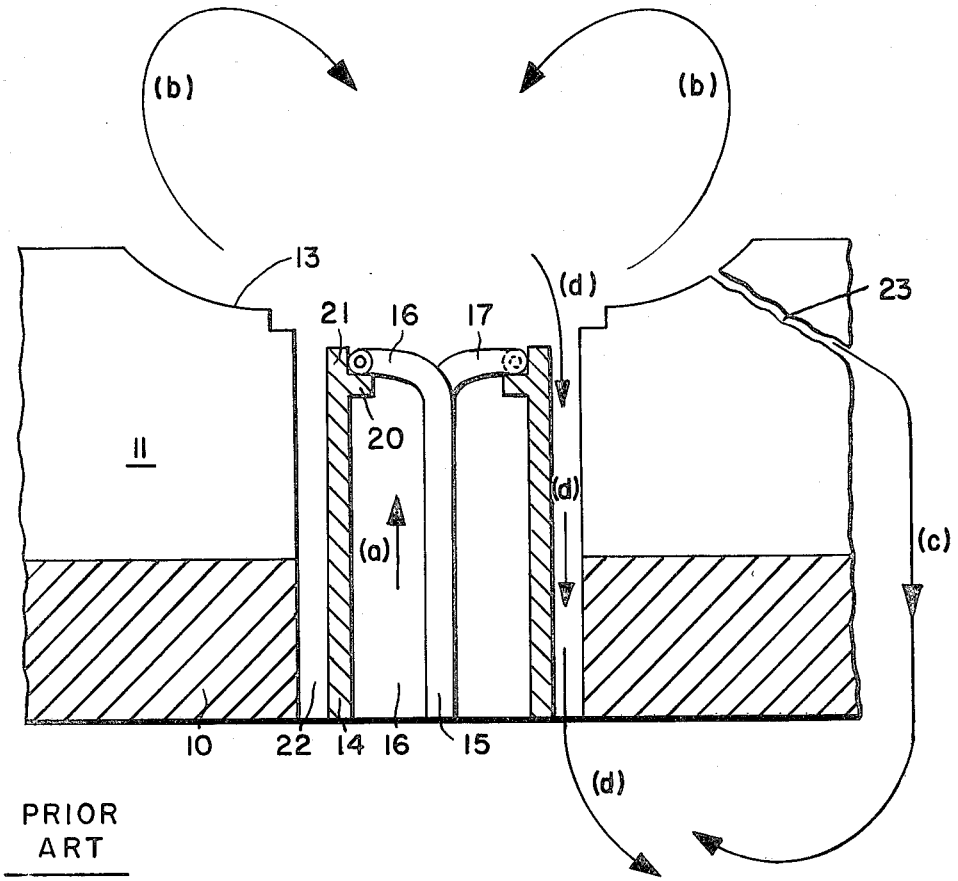

Turning now to FIG. 1 of the drawings, the number 10 represents a portion of a furnace wall and the number 11 designates a burner block installed in the wall. A generally central opening 12 is provided, extending longitudinally through the wall and the burner block, providing a passageway through which combustion supporting air may flow from the back of the furnace, and into the burner cup 13. The burner shown in FIG. 1, which is a prior art burner and may be of the type illustrated in the Patent to Morck U.S. Pat. No. 3,692,460, includes a sleeve 14, a pair of gas pipes 15, the pipes 15 being provided with curved tubular arms 16 and 17. For this purpose, the ends of tubes 16 and 17 are formed as jets or if desired, they can be provided with small spuds similar to the type that are used on inspirator burners. The sleeve 14 includes an inner shelf 20 supporting the tubes 16, 17 and the end extension 21 of sleeve 14 provides a confined area causing the gas emitted from arms 16, 17 to undergo a whirling movment as it leaves the burner tips and passes into the cup 13.

Because of manufacturing tolerances, there is clearance between the sleeve 14 and the furnace wall 10 and the burner block 11, thus providing an annular clearance space 22, which is shown much larger than normal scale for ease of understanding. It will be appreciated, of course, that combustion supporting air flows longitudinally within the sleeve 14, in the direction of the arrow (a) in FIG. 1, for admixture with the fuel released by tubes 16, 17 to form an airfuel mixture adapted for combustion in the cup 13 and in the furnace.

It is possible in the event of improper blocking of cracks or openings by the persons constructing or repairing the furnace or casing that cracking will occur in the burner cup and in the furnace wall, as exemplified by the crack 23 appearing in FIG. 1. Although the crack 23 (shown larger than normal) is shown as extending through the burner cup, it will be appreciated that it, or one or more interconnecting cracks, will be found to extend entirely through the burner cup and furnace wall to the back of the furnace. It has been found that the flow of combustion products in the cup 13, which is an involuting cup producing a generally inwardly-directed, tulip-shaped flow as indicated by the arrows (b) in FIG. 1, causes a positive pressure within the cup, which causes hot combustion gases to flow rearwardly through the crack 23 in the direction of the arrow (c) appearing in FIG. 1. Similarly, elevated pressure in the burner cup tends to cause hot combustion gases to flow rearwardly along the direction indicated by the arrows (d) in FIG. 1, rearwardly toward the furnace casing.

Turning now to FIG. 2, which shows an embodiment of this invention, the number 101 shows a portion of a furnace wall constructed of refractory in the usual manner and having a metal plate 102 to back up the refractory. A burner block 103 is located in the wall. This block has a cup-shaped depression 104 facing the interior of the furnace and having an exvoluting surface 105 also facing the interior of the furnace. The exvoluting surface 105, accordingly, has an outwardly convex curature along which combustion products from the burner are caused to flow. An axial opening 106 extends from the base of the cup-shaped depression 104 at the interior of the furnace, rearwardly through the furnace wall 101, to the outside of the metal plate 102.

The burner of this invention includes a short cylindrical sleeve 107 that is inserted in the opening 106. As shown in the drawings, the inwardly-facing end of the sleeve 107 has a bevel 111 at the end of an annular ridge 108. The bevel 111 provides the sleeve with a raised inner edge adjacent to the inner extremity of the exvoluting cup surface. The beveled edge 111 is angled toward the middle of the sleeve, providing an outwardly facing bevel, preferably at a bevel angle of about 45°.

As shown, the burner block opening 106 is immediately adjacent to the inner extremity of the exvoluting cup surface 105, with nothing intervening. This distinguishes sharply from the disclosure of the Morck U.S. Pat. No. 3,692,460, which includes a cylindrical portion which does intervene.

A sleeve 107, as shown, is fastened into position by bolts 110 which are anchored in the furnace wall 101.

A gas pipe 112 is provided in the opening 106 for providing fuel to the burner. Pipe 112 extends from outside the furnace, and adjacent the burner, it is affixed by means of a gas distributing member 113 to a pair of curved tubular arms 114 and 115 which terminate adjacent to the inner surface of tube 107 within the confines of ridge 108, with the ends of the tubes pointing in a tangential direction substantially perpendicular to the axis of gas pipe 112. Gas is discharged into the burner through pipe 112 and through the arms 114 and 115. For this purpose, the ends of arms 114 and 115 are formed as jets, or, if desired, they can be provided with small spuds similar to the type that are used on inspirator burners.

The outer diameter of ridge 108 is less than the diameter of the opening 106, thus providing passages 109 therethrough for flow of air for flame stabilization which moves in the direction indicated by the arrows (e).

Air for combustion is introduced into the furnace to be mixed with the fuel gas through the center of sleeve 107. The volume of air is controlled by a shutter 116 which is carried by a slotted tube 117 affixed thereto and surrounding the gas pipe 112 for adjustable movement along said gas pipe 112.

The number 120 designates the slots in the tube 117, and guide screws 121 are disposed to extend through such slots for guidance and alignment purposes. The ends 122 of the slotted portions are threaded to accommodate a tightening nut 123. Due to the split nature of the slotted tube 117 in the area of the slots which extends to its end, the end portion of tube 117 is adapted to expand and contract with respect to the diameter of the gas pipe 112, whereupon a firm and permanently effective adjustment of longitudinal position may be accomplished by tightening the beveled screw connection 112, 123. Longitudinal adjustment, in order to control air intake, may be readily achieved by loosening the beveled screw connection 122, 123, repositioning the shutter 116, and re-tightening the beveled screw connection 122, 123.

The member 125 is a typical noise suppresser. The shutter 116, when placed in position, can be slid toward or away from the rear of the furnace wall in order to adjust the size of the opening through which the air flows. The shutter 116 is conventionally formed of metal but is lined with a fibrous material such as glass fiber mat, which acts as a sound absorber when the burner is in operation. Such fibrous glass mat is also included within the noise suppresser 125.

In the operation of the burner, gas under pressure is supplied through pipe 112. The pressure of the gas varies with the capacity at which the burner is to be operated. High velocity swirling jets of fuel gas issuing from arms 114 and 115 create a central, low-pressure region which sucks air through the opening 106, causing it to flow through the sleeve 107 into the exvoluting burner cup 104. Because of the exvoluting shape of the burner cup, the flow of the gas-air combustion products also has a convex form as illustrated by the arrows (f). This creates a negative pressure within the exvoluting burner cup 104, with highly advantageous results. As one such highly advantageous result, the negative pressure within the burner cup 104 draws cooling air through the passage between the burner tube and the burner cup, as indicated by the arrows (e). Further, in the event that a crack should exist, such as the crack 130, air is drawn inwardly through the crack, as indicated by the arrow (g), such air coming from the back of the furnace or from one or more other cracks extending from the back of the furnace to the burner block. The air flowing in the direction indicated by the arrow (g) is cooling air, and is flowing inwardly to the burner cup as sharply distinguished from reverse flow of hot combustion gases rearwardly from the burner cup.

In view of the extreme shortness of the sleeve 107 as compared to the length of the opening 106, even if a positive pressure should momentarily form in the burner cup 104, a recirculation path such as that indicated by the arrow (h) is provided, promptly and without damage returning the hot combustion gases to the burner cup, and preventing rearward flow of the hot combustion gases to the furnace wall 102. It is critical in accordance with this invention to provide a sleeve 107 which is much shorter than the length of the opening 106. This not only cuts off a potential return path for hot combustion gases to the furnace wall, but surprisingly produces a far more effective cooling configuration than any of those of the prior art of which we are aware. Although it might be expected that a shorter and smaller sleeve 107 would require much more cooling in order to protect it from damage, it has surprisingly been found that the combination of the short sleeve 107 together with the air flow passages as indicated, not only fails to produce an overheating problem with respect to sleeve 107 but greatly extends its life instead. Indeed, such a construction permits the utilization of readily available, relatively inexpensive metals for use in fabricating the sleeve 107. Although a variety of factors are involved, it is of particular importance that the short length of the tube sleeve provides a passageway of correspondingly short length, thus greatly minimizing the pressure drop for fluid flow through the intervening passageway, hence affording better air circulation therethrough. In accordance with this invention, combustion air can flow on both sides of the sleeve 107, thereby drastically limiting its temperature.

It will accordingly be understood that the vortex burner of the present invention includes a burner block having an exvoluting contour, an annular gap between the sleeve and the burner block and beveling on the outside surface of the short sleeve. Surprisingly, remarkably improved results are provided by the beveled surface 111. The combination of these elements provides the vortex burner with improved flame stability, an emitted flame that clings to the exvoluted surface, a more uniform heat-flux pattern, and improved annulus pressure characteristics resulting in less critical alignment requirements between the sleeve 107 and the point of juncture between the cup surface 105 and the longitudinal air opening 106. Furthermore, pressures on the burner block face are reduced and bounded by low pressure suction regions. Accordingly, in the event of cracking of the furnace block or of the burner cup, any gases flowing into the cracks are likely to flow into the burner cup or even into the internal furnace area, rather than rearwardly to the furnace casing.

As heretofore indicated, it would normally be expected to be disadvantageous to provide a short sleeve 107 of the type heretofore discussed, because the sleeve is subject to heating and possibly to overheating. For this very reason, some of the most expensive alloy castings in the world are now used for producing burner sleeves in other forms of burners. It would normally be expected that providing such a short sleeve, would simply subject it to even more intensified heating and that the metal of the tube would prematurely fail. Surprisingly, the contrary is true. With the construction and arrangement in accordance with this invention, even if gases were to flow rearwardly through the annular space between the sleeve 107 and the opening 106, those gases would immediately be drawn back into the center of the sleeve 107, and would then flow forwardly into the burner cup 104. However, it should be emphasized that in the normal operation of the burner, the foregoing event does not occur because a negative pressure exists within the burner cup 104 which causes the gases to flow forwardly into the burner cup. It has surprisingly been experienced that with the short burner sleeve 107, the sleeve runs at a much lower temperature than has been experienced in connection with other burners, and can even be provided in a less expensive and less exotic metal than the special alloys heretofore used.

The provision of the bevel 111 is highly important and advantageous, as contrasted to the provision of a flat surface on the sleeve 107 adjacent the burner cup, which would cause a swirling motion of the combustion products tending to induce them to flow rearwardly through the passage between the tube and the surface of the opening 106. Utilizing a bevel 111 as shown in FIG. 2 of the drawings, the combustion products tend to flow over the edge of the bevel 111 and in an outwardly-directed manner along the exvoluting burner cup surface 105, thus providing a highly desirable low pressure area therein, and thus inducing all cooling air to flow in a forward direction from the furnace casing toward and into the burner cup.

Another advantage in connection with the short length sleeve 107 is that it reduces the overall resistance to flow of air through the intervening passageway. The longer the intervening passageway may be, the greater its total resistance is to flow. Thus, by making the intervening passageway shorter, the total resistance becomes less, thus making it easier for cooling air to flow in a forward direction through the intervening space.

The characteristics of the slots 120 cooperate with the nature and arrangement of the shutter 116 and the manner in which the same is secured in position, by providing selectively regulated and firmly adjusted air supply which contributes to uniformity of operation of the burner.

Although this invention has been described with reference to a specific embodiment thereof, many variations may be made including the substitution of equivalents, the use of certain features independently of other features, and reversals of parts, all within the spirit and scope of the invention as defined in the appended claims.

We claim:

1. In a vortex burner having a burner block with a generally longitudinally extending opening, said block having a cup therein at the outer end of said opening, a cylindrical sleeve positioned in said opening for feeding combustion supporting air therethrough, said sleeve containing a fuel supply means for conveying fuel to a position within the sleeve and whirling the fuel against the inner wall of the sleeve, the improvement comprising the combination of:

(a) said cup having an outwardly convex curvature forming a surface along which the combustion products flow in a radially outward direction from said opening, the surface causing the radially flowing combustion products to form a negative pressure in the cup;

(b) the length of said sleeve being substantially less than said burner block opening, the outer dimension of the sleeve being smaller than the inner dimension of the burner block opening thereby providing an annular passageway between them;

(c) means forming an air passage in communication with the inner end of the opening in said burner block; and (d) said sleeve having a central opening in communication with said air passage and having a thin beveled edge on its outer portion extending slightly beyond the outer end of the opening in said burner block so that a low pressure region is formed by said thin edge.

* * * * *